US010544769B2

(12) United States Patent
Brown et al.

(10) Patent No.: US 10,544,769 B2
(45) Date of Patent: Jan. 28, 2020

(54) STAND-ALONE COMMON RAIL CAPABLE INJECTOR SYSTEM

(71) Applicant: Caterpillar Inc., Peoria, IL (US)

(72) Inventors: Aaron M. Brown, Peoria, IL (US); Cory A. Brown, Peoria, IL (US); Sridhar Thangaswamy, Dunlap, IL (US); Alan R. Stockner, Metamora, IL (US); Victor I. Yacoub, Washington, IL (US); Zhenyu Li, Peoria, IL (US); Lifeng Wang, Dunlap, IL (US); Satya Naga Deepak Pillarisetti, Pontiac, IL (US); Scott Shafer, Morton, IL (US); Robert Michael Campion, Chillicothe, IL (US); George Kodikulam Joseph, Pontiac, IL (US)

(73) Assignee: Caterpillar Inc., Peoria, IL (US)

( * ) Notice: Subject to any disclaimer, the term of this patent is extended or adjusted under 35 U.S.C. 154(b) by 119 days.

(21) Appl. No.: 15/726,950

(22) Filed: Oct. 6, 2017

(65) Prior Publication Data

US 2018/0100476 A1 Apr. 12, 2018

Related U.S. Application Data

(63) Continuation-in-part of application No. 15/288,729, filed on Oct. 7, 2016.

(51) Int. Cl.
*F02M 57/02* (2006.01)
*F02M 55/02* (2006.01)
(Continued)

(52) U.S. Cl.
CPC ..... *F02M 57/027* (2013.01); *F02D 41/3863* (2013.01); *F02M 47/027* (2013.01); *F02M 55/025* (2013.01); *F02D 2200/0602* (2013.01)

(58) Field of Classification Search
CPC .. F02M 55/025; F02M 55/005; F02M 69/465; F02M 55/004; F02M 63/005;
(Continued)

(56) References Cited

U.S. PATENT DOCUMENTS 6,484,697 B2 * 11/2002 Boecking ..... F02M 47/025 123/467
6,527,198 B1 * 3/2003 Stoecklein ..... F02M 47/025 239/102.2
(Continued)

FOREIGN PATENT DOCUMENTS

CN 101067406 B 3/2011
DE 102007000072 A1 8/2007
(Continued)

*Primary Examiner* — Sizo B Vilakazi
(74) *Attorney, Agent, or Firm* — Jonathan F. Yates

(57) ABSTRACT

A fuel system is disclosed for use with an engine, including a fuel injector assembly fluidly coupled with a low-pressure fuel conduit, an accumulator, and a cap within an opening in the accumulator. The fuel injector assembly may be structured to draw in low-pressure fuel, pressurize the fuel, and store the pressurized fuel in the accumulator for injection to a combustion chamber. The cap has a pressure sensor and a pressure relief valve therein, and drains fuel leaked past fluid seals between the cap and each of the pressure sensor, the pressure relief valve, and the accumulator by way of a common drain line.

9 Claims, 9 Drawing Sheets

(51) Int. Cl.
*F02M 47/02* (2006.01)
*F02D 41/38* (2006.01)

(58) Field of Classification Search
CPC .. F02M 63/0265; F02M 39/02; F02M 55/002; F02M 57/005; F02M 57/023; F02M 63/0225; F02M 57/027; F02M 47/027; F02M 59/022; F02M 2200/247; F02M 2200/16; F02D 41/3863; F02D 41/0082; F02D 41/3094; F02D 2041/3881; F02D 2200/0602; F02F 7/006
See application file for complete search history.

(56) References Cited

U.S. PATENT DOCUMENTS

| | | | | |
|---|---|---|---|---|
| 8,708,249 | B2 * | 4/2014 | Lecluse | F02M 63/0029 239/124 |
| 9,127,629 | B2 * | 9/2015 | Yamada | F02M 47/027 |
| 2010/0288018 | A1 * | 11/2010 | Hopmann | F02M 55/002 73/40.5 R |

FOREIGN PATENT DOCUMENTS

| | | | |
|---|---|---|---|
| DE | 102014209298 | A1 | 11/2014 |
| WO | 2011078153 | A1 | 6/2011 |

* cited by examiner

STAND-ALONE COMMON RAIL CAPABLE INJECTOR SYSTEM

TECHNICAL FIELD

The present disclosure is directed to a fuel system and, more particularly, to a fuel system having stand-alone pump-accumulator-injectors.

BACKGROUND

Internal combustion engines such as diesel engines and gasoline engines use injectors to introduce fuel into combustion chambers of the engine. Two types of fuel systems are commonly used in modern engines, including a common rail (CR) fuel system and a mechanical unit injector (MUI) fuel system.

A CR fuel system includes a centralized high-pressure pump that feeds pressurized fuel to an accumulator (a.k.a., rail), and a plurality of electronically controlled fuel valves that are supplied with fuel by the accumulator. When a fuel valve inside each injector opens, pressurized fuel from the accumulator flows through an injector nozzle and sprays into an associated combustion chamber.

In contrast to a CR system, a MUI system does not include a centralized high-pressure pump. Instead, the MUI system relies on a cam-driven unit pump for each injector. As a cam rotates to push a lobe against a plunger of the unit pump, high-pressure fuel is forced from the unit pump through an injector nozzle and into an associated combustion chamber.

Competition and government regulations force engine manufacturers to continually improve engine performance, with respect to power, fuel efficiency, and emissions. One way to improve engine performance is to increase fuel injection pressure while also decreasing fuel injection duration. Conventional CR and MUI fuel systems struggle to provide the required higher-pressures within the shorter injection durations.

One attempt to provide a higher performing fuel system is disclosed in U.S. Pat. No. 7,077,101 of Poola et al. that issued on Jul. 18, 2006 ("the '101 patent"). In particular, the '101 patent discloses a hybrid fuel injection system having CR components (i.e., a high-pressure pump that feeds an accumulator or rail) and MUI components (i.e., unit-pump injectors that communicate with the rail). With this arrangement, fuel from the unit pump provides for the main injection of the fuel injector, while fuel from the accumulator provides fuel for one or more auxiliary fuel injections.

Although the hybrid system of the '101 patent may exhibit benefits of a combined CR and MUI system, it may still be less than optimal. In particular, the system may be complex and expensive. In addition, the hybrid system may lack design flexibility and have limited retrofitting capabilities with respect to existing engines.

The fuel system of the present disclosure solves one or more of the problems set forth above.

SUMMARY

One aspect of the present disclosure is directed to a fuel injector for a fuel system having a common rail. The fuel injector may include a pumping portion having a bore formed therein, and a plunger reciprocatingly disposed in the bore. The fuel injector may also include an accumulator portion fluidly connectable to the common rail and configured to receive fuel pushed from the bore of the pumping portion by the plunger. The fuel injector may further include a nozzle portion, and a valve portion connecting the pumping, nozzle, and accumulator portions.

Another aspect of the present disclosure is directed to a fuel system. The fuel system may include a common rail, a first type of fuel injector fluidly connected to the common rail, and a second type of fuel injector fluidly connected to the common rail. The second type of fuel injector may include a pumping portion having a bore formed therein, and a plunger reciprocatingly disposed in the bore. The second type of fuel injector may further include an accumulator portion fluidly connected to the common rail and configured to receive fuel pushed from the bore of the pumping portion by the plunger, a nozzle portion, and a valve portion fluidly connecting the pumping, nozzle, and accumulator portions.

In yet another aspect, the present disclosure is directed to an engine. The engine may include an engine block at least partially defining a plurality of cylinders, a piston disposed within each of the plurality of cylinders, and at least one cylinder head configured to close off the plurality of cylinders and thereby form a plurality of combustion chambers. The engine may also include a common rail, a first type of fuel injector disposed at least partially within the at least one cylinder head and configured to inject fuel received from the common rail into a first of the plurality of combustion chambers, and a second type of fuel injector disposed at least partially within the at least one cylinder head and configured to pump fuel into the common rail and to inject fuel into a second of the plurality of combustion chambers. Each of the first and second types of fuel injectors may include an accumulator portion configured to hold pressurized fuel for subsequent injection events. The second type of fuel injector may further include a pumping portion having a bore formed therein, a plunger reciprocatingly disposed in the bore, the accumulator portion fluidly connected to the common rail and configured to receive fuel pushed from the bore of the pumping portion by the plunger, a nozzle portion, and a valve portion fluidly connecting the pumping, nozzle, and accumulator portions.

In another aspect, a cap for closing an opening in a pressure vessel in a pressurized fuel injection system includes a cap body defining a longitudinal axis extending between a proximal cap body end and a distal cap body end, and a transverse axis. The cap body has a first sealing surface extending circumferentially around the longitudinal axis, a second sealing surface extending circumferentially around the transverse axis, and a third sealing surface. The cap body further has formed therein a high-pressure passage including a first high-pressure opening, a second high-pressure opening, and a third high-pressure opening surrounded, respectively, by the first sealing surface, the second sealing surface, and the third sealing surface. The cap body further has formed therein a low-pressure passage including a first drain opening outboard of the first sealing surface to receive fuel leaked past a first seal formed between the first sealing surface and the pressure vessel, a second drain opening outboard of the second sealing surface to receive fuel leaked past a second seal formed between the second sealing surface and a pressure control component, and a third drain opening outboard of the third sealing surface.

In another aspect, a fuel injector assembly includes a fuel injector that includes a pump having a bore formed therein, and a plunger disposed at least partially within the bore. The fuel injector assembly further includes an accumulator attached to the fuel injector and having an opening formed therein, and being fluidly coupled with the pump to receive fuel pressurized by way of reciprocation of the plunger within the bore. The fuel injector assembly further includes a cap positioned within the opening in the accumulator, the cap having formed therein a passage structured to fluidly couple the accumulator with a pressure control component. The cap further includes a plurality of sealing surfaces, one of the plurality of sealing surfaces forming a seal with the accumulator, and another one of the plurality of sealing surfaces being structured to form a seal with the pressure control component.

In still another aspect, a pressurized fuel system includes a low-pressure fuel conduit, and a plurality of fuel injector assemblies each including a fuel injector and a high-pressure accumulator attached to the corresponding fuel injector. Each of the fuel injectors include a pump assembly and an injector body, the injector body having formed therein an inlet passage fluidly coupled to the low-pressure fuel conduit, and a discharge passage structured to convey pressurized fuel from the pump assembly to the attached high-pressure accumulator. Each of the fuel injectors further includes an electrically-actuated injection control valve, a nozzle, and an accumulator passage formed within the injector body and structured to convey pressurized fuel from the high-pressure accumulator to the nozzle.

DETAILED DESCRIPTION

Figure 1:
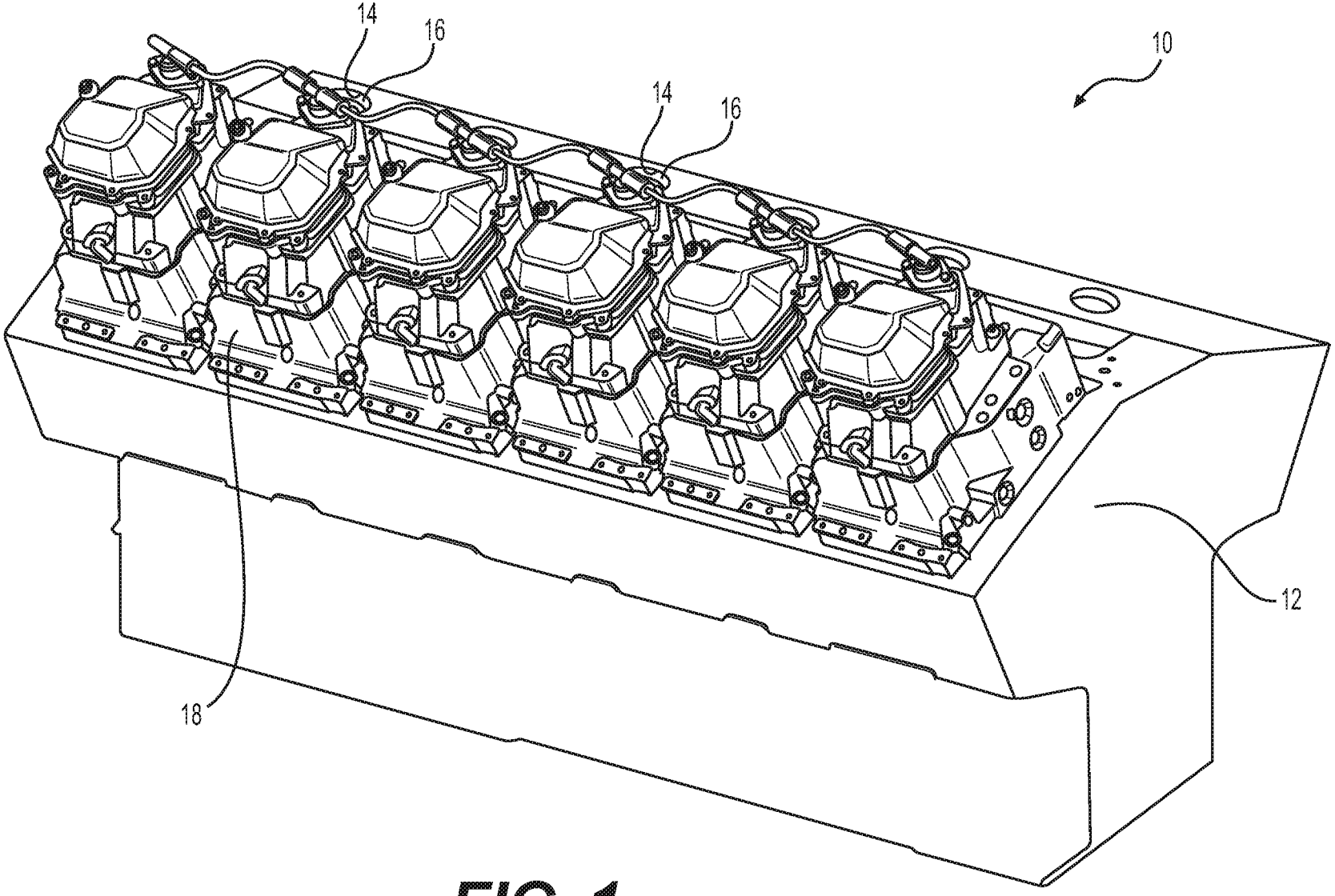
FIG. 1 is a perspective illustration of an exemplary disclosed engine.

FIG. 1 illustrates an engine 10. For the purposes of this disclosure, engine 10 is depicted and described as a four-stroke compression injection diesel engine. One skilled in the art will recognize, however, that engine 10 may be any other type of internal combustion engine such as, for example, a spark ignited gasoline engine. Engine 10 may include an engine block 12 that at least partially defines a plurality of cylinders 14, a piston 16 slidably disposed within each cylinder 14, and a cylinder head 18 associated with each cylinder 14.

Figure 2:
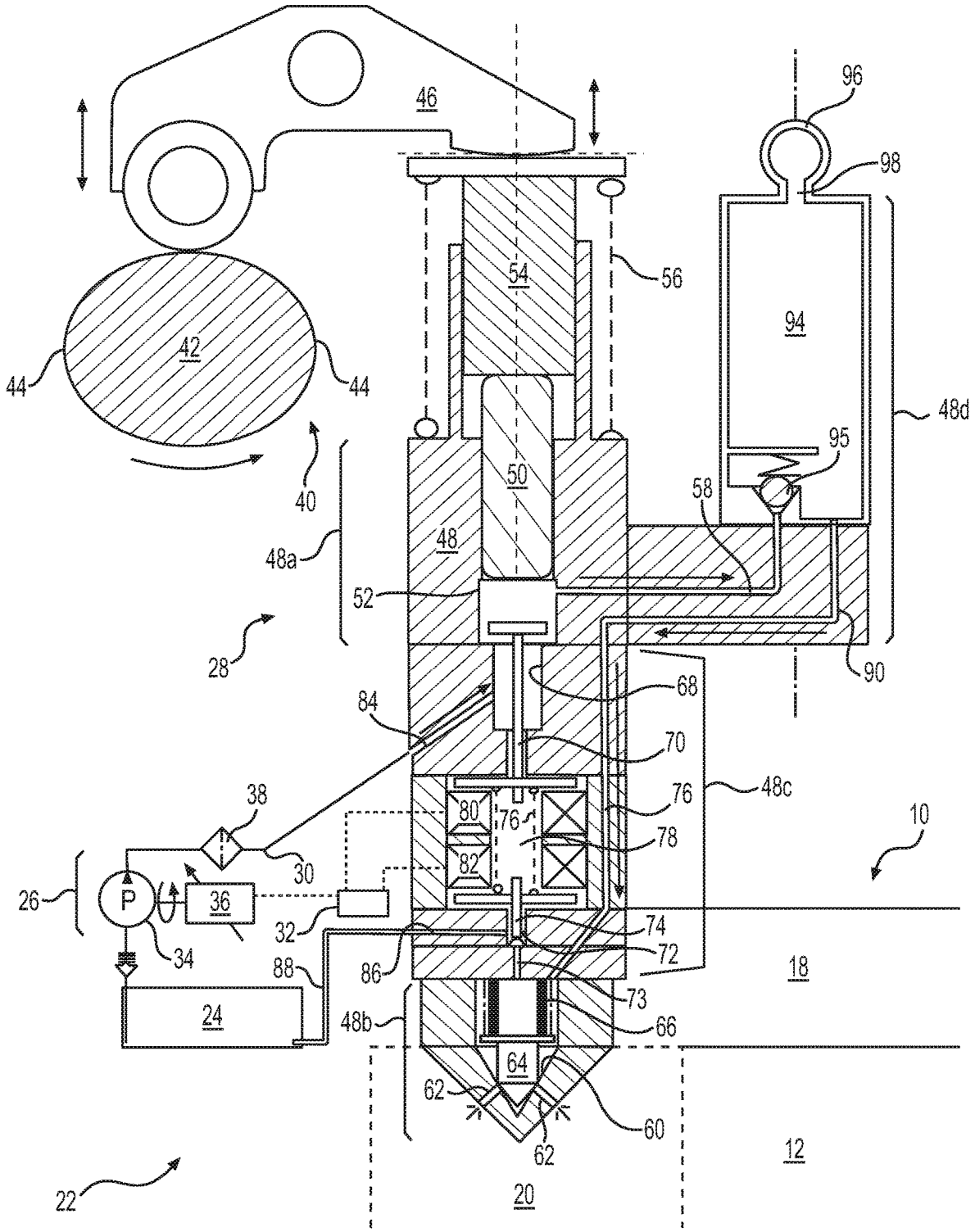
FIG. 2 is a schematic and diagrammatic illustration of an exemplary disclosed fuel system that may be used in conjunction with the engine of FIG. 1.

Cylinder 14, piston 16, and cylinder head 18 may together form a combustion chamber 20 (shown only in FIG. 2). In the illustrated embodiment, engine 10 includes twelve combustion chambers 20 arranged in a "V"-configuration. However, it is contemplated that engine 10 may include a greater or lesser number of combustion chambers 20 and that combustion chambers 20 may be disposed in an "in-line" configuration, in an "opposing-piston" configuration, or in any other suitable configuration.

As shown in FIG. 2, a fuel system 22 may be associated with engine 10 and include components that cooperate to deliver injections of pressurized fuel into each combustion chamber 20. These components may include, among other things, a tank 24 configured to hold a supply of fuel, a fuel pumping arrangement 26 configured to pressurize the fuel and direct the pressurized fuel to a plurality of fuel injectors 28 (only one shown in FIG. 2) by way of a one or more supply passages 30, and a controller 32 in communication with pumping arrangement 26 and fuel injectors 28.

Fuel pumping arrangement 26 may include one or more pumping devices that function to increase the pressure of the fuel and direct one or more pressurized streams of fuel into supply passage(s) 30. In one example, fuel pumping arrangement 26 includes a low-pressure source 34. Low-pressure source 34 may embody, for example, a transfer pump that is powered by a variable speed electric motor 36 to provide low-pressure feed to injectors 28 via passage(s) 30. A filter 38 may be disposed within fuel line(s) 30, if desired. It is contemplated that fuel pumping arrangement 26 may include additional and/or different components than those listed above such as, for example, a high-pressure source disposed in series with or used in place of low-pressure source 34.

An exemplary fuel injector 28 is illustrated in FIG. 2 as being disposed at least partially within a corresponding cylinder head 18. In this example, fuel injector 28 is mechanically driven by a cam arrangement 40 to selectively pressurize fuel within fuel injector 28 to a desired pressure level for use in future injection events. Cam arrangement 40 may include a cam 42 operatively connected to a crankshaft (not shown) of engine 10 such that a rotation of the crankshaft results in a corresponding rotation of cam 42. During rotation of cam 42, one or more lobes 44 may periodically drive a pumping action of fuel injector 28 via a pivoting rocker arm 46. It is contemplated that the pumping action of fuel injector 28 may alternatively be driven directly by lobe(s) 44 without the use of rocker arm 46 or that a pushrod (not shown) may be disposed between rocker arm 46 and fuel injector 28 or between rocker arm 46 and cam 42, if desired.

Fuel injector 28 may include multiple components that interact to pressurize and inject fuel into combustion chamber 20 of engine 10 in response to the driving motion of cam arrangement 40. In particular, each fuel injector 28 may include an injector body 48 divided into or otherwise enclosing a pumping portion 48*a*, a nozzle portion 48*b*, a valve portion 48*c* located between pumping and nozzle portions 48*a* and 48*b*, and an accumulator portion 48*d*. The driving motion of cam arrangement 40 described above may result in low-pressure fuel being drawn from passage 30 into pumping portion 48*a*, and high-pressure fuel being discharged from pumping portion 48*a* into accumulator portion 48*d*. Nozzle portion 48*b* may selectively discharge high-pressure fuel received from accumulator portion 48*d* into combustion chamber 20. Valve portion 48*c* may regulate various flows of fuel between the other portions of injector body 48.

Pumping portion 48*a* may include a plunger 50 reciprocatingly disposed at least partially within a bore 52. Plunger 50 may be operatively connected to rocker arm 46 via a tappet 54. Tappet 54 may be retained in continuous engagement with rocker arm 46 by a plunger spring 56. Low-pressure fuel may flow from valve portion 48*c* into bore 52 of pumping portion 48*a* during a retracting (e.g., upward) stroke of rocker arm 46, tappet 54, and plunger 50. High-pressure fuel may be forced from bore 52 into accumulator portion 48*d* via a discharge passage 58 during a contracting (e.g., downward) stroke of rocker arm 46, tappet 54, and plunger 50.

Nozzle portion 48*b* may be located at least partially inside cylinder head 18 and include an internal pressure chamber 60 that is fluidly connected with combustion chamber 20 via one or more orifices 62. A valve needle 64 may be reciprocatingly disposed within chamber 20 and movable from a first or closed position (shown in FIG. 2) to a second or open position (not shown). When valve needle 64 is in the closed position, orifices 62 may be blocked from combustion chamber 20 by a tip end of valve needle 64. When valve needle 64 is in the open position, fuel may flow from chamber 60 through orifices 62 unimpeded by valve needle 64. A needle spring 66 may urge valve needle 64 toward the closed position.

Valve portion 48*c* may connect plunger portion 48*a* with nozzle and accumulator portions 48*b*, 48*d*, and also contain one or more valves that facilitate fuel flows therebetween. In the disclosed example, valve portion 48*c* includes a spill chamber 68 open to bore 52 of plunger portion 48*a*, a spill valve 70 associated with spill chamber 68, a control chamber 72 fluidly connected with pressure chamber 60 of nozzle portion 48*b* (e.g., via a restricted orifice 73), a control valve 74 associated with control chamber 72, a spring 76 disposed within a spring chamber 78 between spill and control valves 70 and 74, a first electrical actuator 80 configured to control movements of spill valve 70, and a second electrical actuator 82 configured to control movements of control valve 74. An inlet passage 84 may fluidly connect supply passage 30 with spill chamber 68. An outlet passage 86 may fluidly connect control chamber 72 with a return line 88 that leads back to tank 24. A nozzle supply passage 90 may extend from accumulator portion 48*d* through valve portion 48*c* to pressure chamber 60 of nozzle portion 48*b*.

First and second actuators 80, 82 may be selectively energized by controller 32 to cause movements of spill and control valves 70, 74, respectively. In particular, spill valve 70 may be moved from a first or open position (shown in FIG. 2) to a second or closed position (not shown) when first actuator 80 is energized, and spring-biased (e.g., via spring 76) back toward the open position when first actuator 80 is de-energized. In contrast, control valve 74 may be moved from a first or closed position (shown in FIG. 2) to a second or open position (not shown) when second actuator 82 is energized and spring-biased (e.g., via spring 76) back toward the closed position when second actuator 82 is de-energized.

When spill valve 70 is in the open position during a retracting stroke of plunger 50, low-pressure fuel may be forced and/or drawn into bore 52 via inlet passage 84 and spill chamber 68. When spill valve 70 is in the closed position during a contracting stroke of plunger 50, high-pressure fuel may be inhibited by spill valve 70 from passing through spill chamber 68 and inlet passage 84, thereby forcing the displacing fuel to instead flow through passage 58 and into accumulator portion 48*d*. However, when spill valve 70 is in the open position during the contracting stroke, some or all of the fuel being displaced from bore 52 by plunger 50 may be allowed to "spill" through spill chamber 68 and inlet passage 84. When fuel forced from bore 52 is allowed to exit fuel injector 28 via inlet passage 84, the buildup of pressure within fuel injector 28 due to contracting stroke of plunger 50 may be minimal. Accordingly, by timing an opening and closing of spill valve 70 relative to the strokes of plunger 50, an amount and/or pressure of the fuel being displaced by plunger 50 and directed into accumulator portion 48*d* may be regulated by controller 32.

When control valve 74 is in the open position, high-pressure fuel at a base end of valve needle 64 may be allowed to drain through restricted orifice 73, control chamber 72, outlet passage 86, and return line 88 to tank 24. As the fluid pressure at the base end of valve needle 64 drops with the draining fuel, the high-pressure fuel acting at a tip end of valve needle 64 may create a pressure imbalance that forces valve needle 64 upward against the bias of spring 66 to the open position at which fuel discharge from injector 28 begins. When control valve 74 is in the closed position, pressure may build at the base end of valve needle 64, thereby balancing pressures across valve needle 64 and allowing spring 66 to move valve needle 64 to the closed position to stop fuel injection. Accordingly, by timing an opening and closing of control valve 74, a fuel injection time, amount and/or pressure may be regulated by controller 32.

First and second electrical actuators 80, 82 may each include a solenoid, and an armature fixedly connected to the respective valve (e.g., to spill valve 70 or to control valve 74). The solenoid may include windings of a suitable shape and/or size through which current may flow to establish a magnetic field that, when energized, draws the corresponding armature toward itself. It is contemplated that first and/or second electrical actuators 80, 82 may embody another type of actuator (e.g., a piezo motor), if desired. It is further contemplated that first and second electrical actuators 80, 82 may be combined in some embodiments.

Accumulator portion 48*d* may be rigidly connected to plunger and/or valve portions 48*a*, 48*c* of injector body 48. In one embodiment, accumulator portion 48*d* may be generally cylindrical and have a center axis that is offset from and parallel to a center axis of pumping, nozzle, and valve portions 48*a*, 48*b*, and 48*c*. In some embodiments, accumulator portion 48*d* may be integrally formed (e.g., cast, machined, printed, etc.) with one or both of pumping and valve portions 48*a*, 48*c*. Accumulator portion 48*d* may include, among other things, a pressure chamber 94 configured to collect high-pressure fuel pushed from bore 52 by plunger 50. The high-pressure fuel of bore 52 may pass from discharge passage 58 through a check valve (e.g., a spring-biased check valve) 95 before entering pressure chamber 94. Pressure chamber 94 may be fluidly connected with pressure chamber 60 of nozzle portion 48*b* via nozzle supply passage 90. Pressure chamber 94, on the disclosed example, has a volume that is greater than an amount of fuel injected during any one injection event by a single injector 28 (e.g., 15 to 50 times greater), such that one injection event does not exhaust a supply of fuel stored within pressure chamber 94. For the purposes of this disclosure, an injection event may be considered to include all fuel injections by a single fuel injector 28 during a complete combustion cycle of engine 10.

Figure 3:
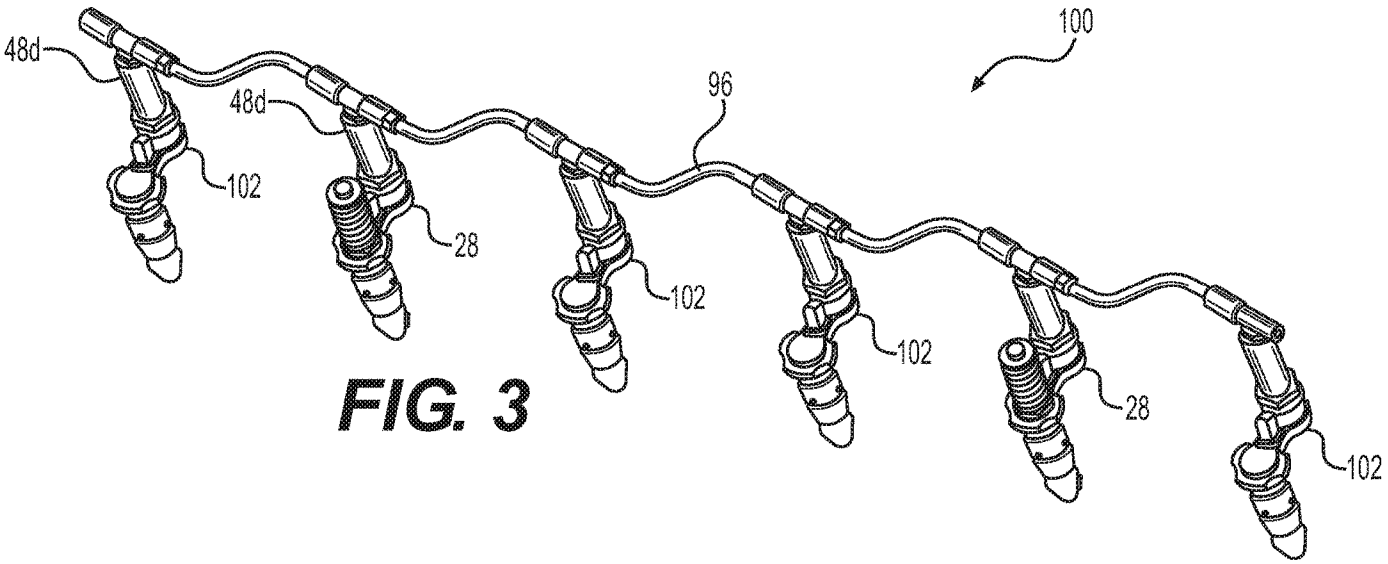
FIGS. 3 and 4 are perspective illustrations of exemplary disclosed portions of the fuel system of FIG. 2.
Figure 4:
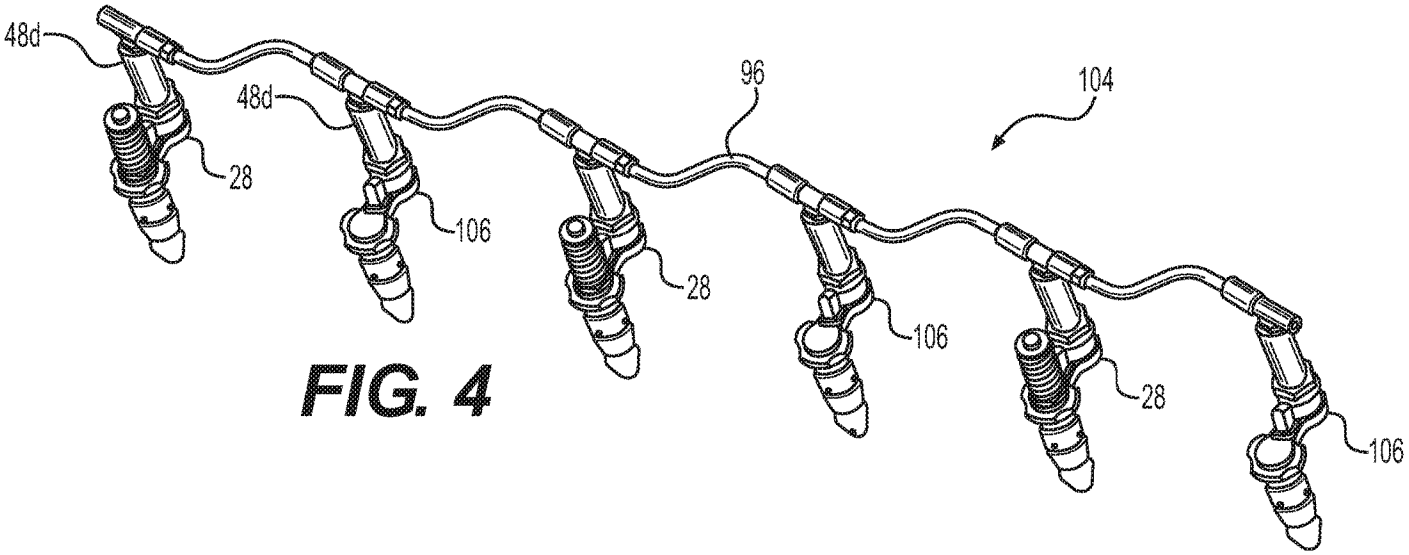

As shown in FIGS. 2-4, the pressure chamber 94 of one fuel injector 28 may be connected to the pressure chamber of another fuel injector 28, in some embodiments. For example, a common rail 96 may extend between accumulator portions 48*d* of multiple fuel injectors 28, if desired. As will be appreciated from the discussion herein, some embodiments of the present disclosure may include one or more fuel injectors and/or fuel injector assemblies that are not in fluid communication with the common rail, or may not include a common rail or other shared pressure vessel at all. In some instances, a restricted orifice 98 may be located between common rail 96 and each pressure chamber 94 to help reduce the generation of pressure fluctuations within common rail 96.

FIG. 3 illustrates an exemplary fuel injector arrangement ("arrangement") 100 that may be used in some fuel system configurations of engine 10. As can be seen in this figure, one or more fuel injectors 28 may be interspersed with one or more other types of fuel injectors and connected to each other via common rail 96. In the specific example of arrangement 100 shown in FIG. 3, two fuel injectors 28 are fluidly connected to four other fuel injectors 102 of a different type. In particular, arrangement 100 includes twice as many fuel injectors 102 as fuel injectors 28, wherein each fuel injector 28 is fluidly located between two fuel injectors 102. In addition, two fuel injectors 102 are shown as being located immediately adjacent each other at a center of arrangement 100; and terminal ends of arrangement 100 are connected to fuel injectors 102. It should be noted that engine 10 may include two of arrangements 100, with each arrangement 100 being associated with a separate bank of cylinders 14 (referring to FIG. 1).

FIG. 4 illustrates another exemplary fuel injector arrangement ("arrangement") 104 that may be used in some fuel system configurations of engine 10. As can be seen in this figure, one or more fuel injectors 28 may be interspersed with one or more other types of fuel injectors and connected to each other via common rail 96. In the specific example of arrangement 104 shown in FIG. 4, three fuel injectors 28 are fluidly connected to three other fuel injectors 102 of a different type. In particular, arrangement 104 includes an equal number of fuel injectors 28 and 102, with the location of each type of fuel injector alternating along a length of arrangement 104. In addition, a first terminal end of arrangement 104 is connected to fuel injector 28, while an opposing terminal end of arrangement 104 is connected to fuel injector 102. It should be noted that engine 10 may include two of arrangements 104, wherein each arrangement 104 is associated with a separate bank of combustion cylinders 14 (referring to FIG. 1). It is contemplated, however, that in some embodiments, two different fuel injector arrangements could be utilized, if desired.

Figure 5:
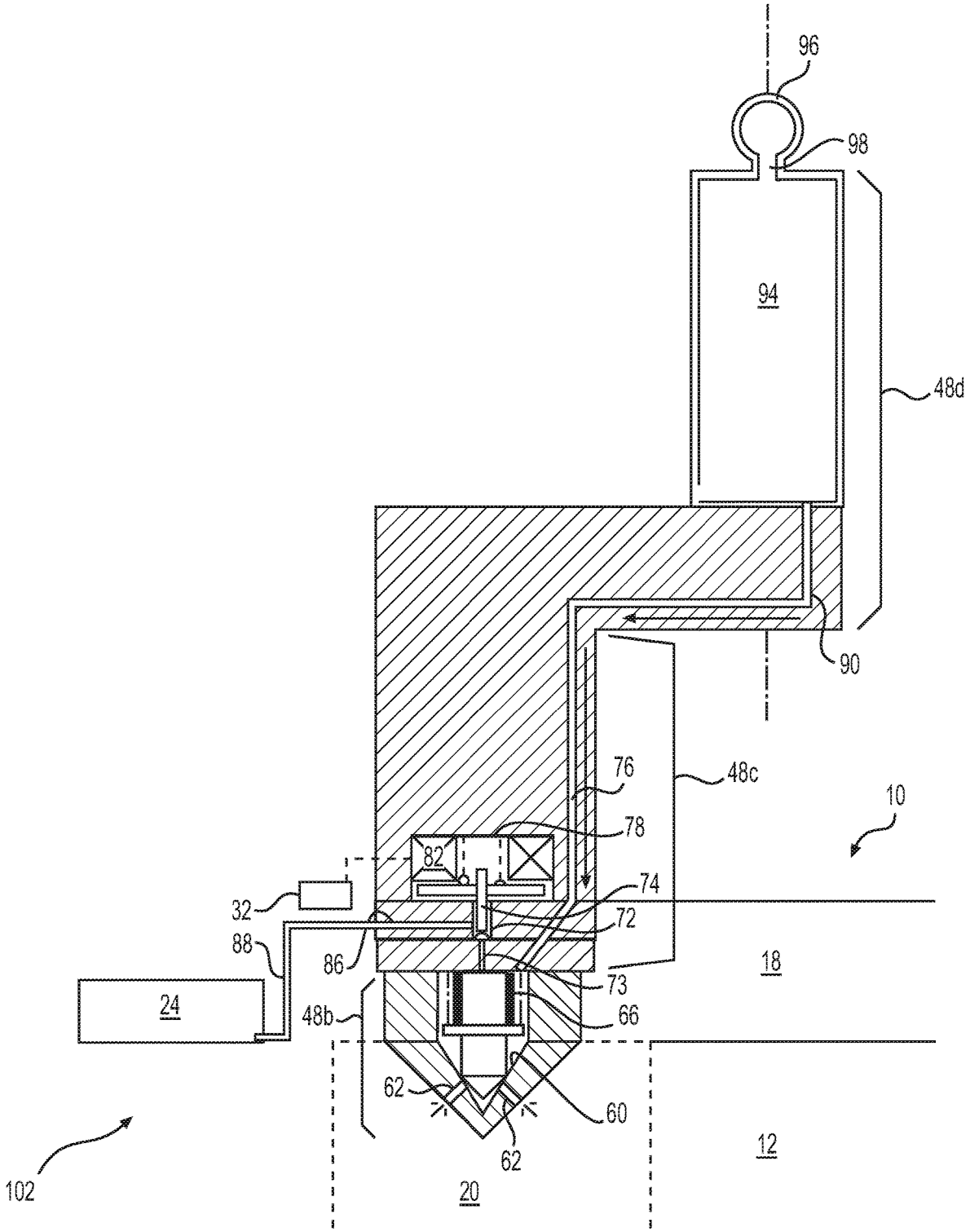
FIG. 5 is a schematic and diagrammatic illustration of an exemplary disclosed fuel injector that may be used in conjunction with the fuel system of FIG. 2.

As shown in FIG. 5, fuel injector 102 may be similar to fuel injector 28 in many respects. For example, fuel injector 102 may include nozzle portion 48*b*, valve portion 48*c*, and accumulator portion 48*d*. In fact, pressure chamber 94 of each fuel injector 28 may be fluidly connected via common rail 96 to a substantially identical pressure chamber 94 of an adjacent fuel injector 102. However, in contrast to fuel injector 28, fuel injector 102 may not include pumping portion 48*a*. That is, fuel injector 102 may be a simpler common rail type of fuel injector that is configured to inject high-pressure fuel received only from common rail 96. Fuel injector 102 may not internally increase a fuel pressure in the way that fuel injectors 28 do. In addition, the components of fuel injector 28 normally used to regulate fuel pumping (e.g., spill chamber 68, spill valve 70, electrical actuator 80, and inlet passage 84) may be omitted from valve portion 48*c* of fuel injector 102.

Because fuel injectors 102 may not internally pressurize fuel for injection, the fuel pressurized by fuel injectors 28 must be sufficient to provide for the injection needs of all fuel injectors connected in the same arrangement. Accordingly, each fuel injector 28 of arrangement 100 (referring to FIG. 3) may be required to pressurize three times as much fuel (or more) as is self-injected. Similarly, each fuel injector 28 of arrangement 104 (referring to FIG. 4) may be required to pressurize twice as much fuel (or more) as is self-injected.

Figure 6:
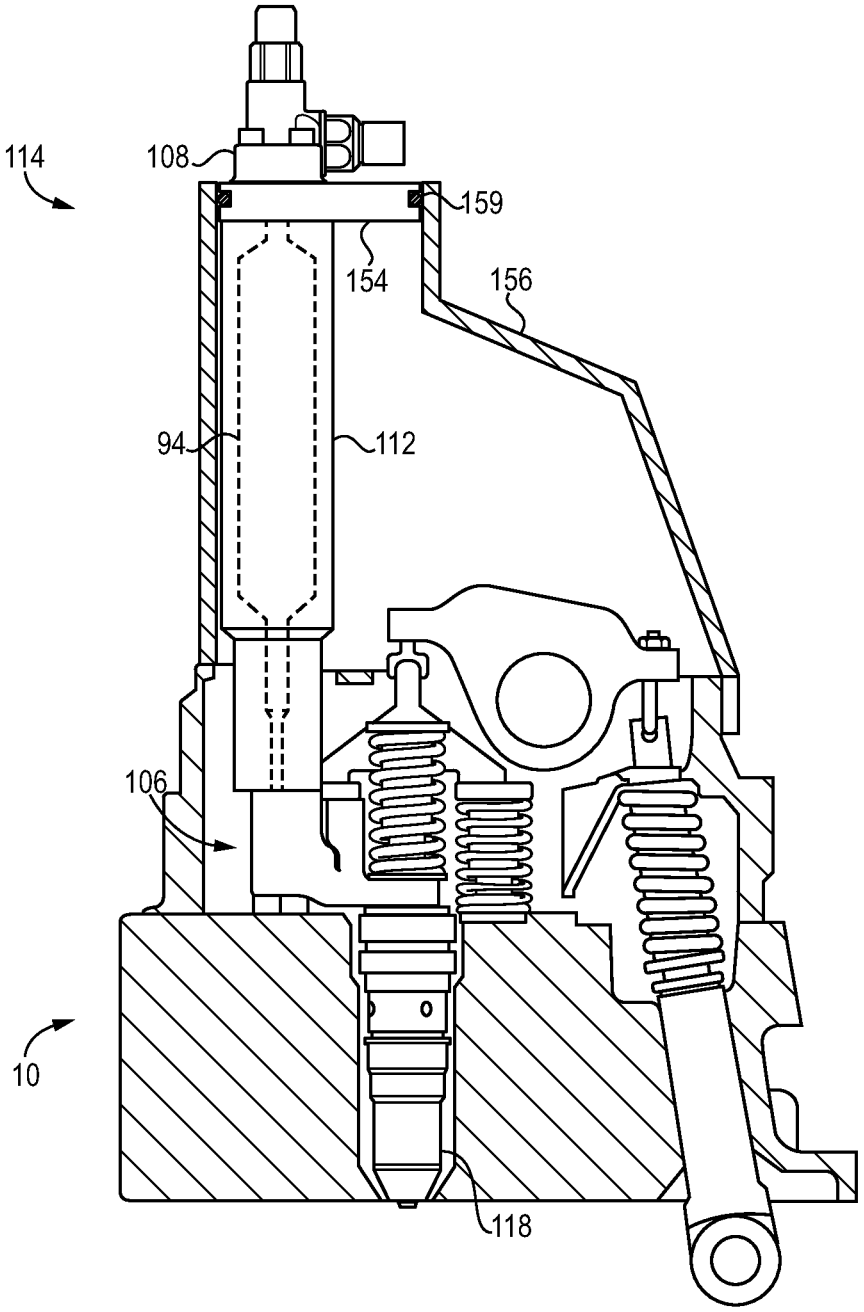
FIG. 6 is a partially sectioned side view of an exemplary disclosed pressurized fuel injection system.
Figure 7:
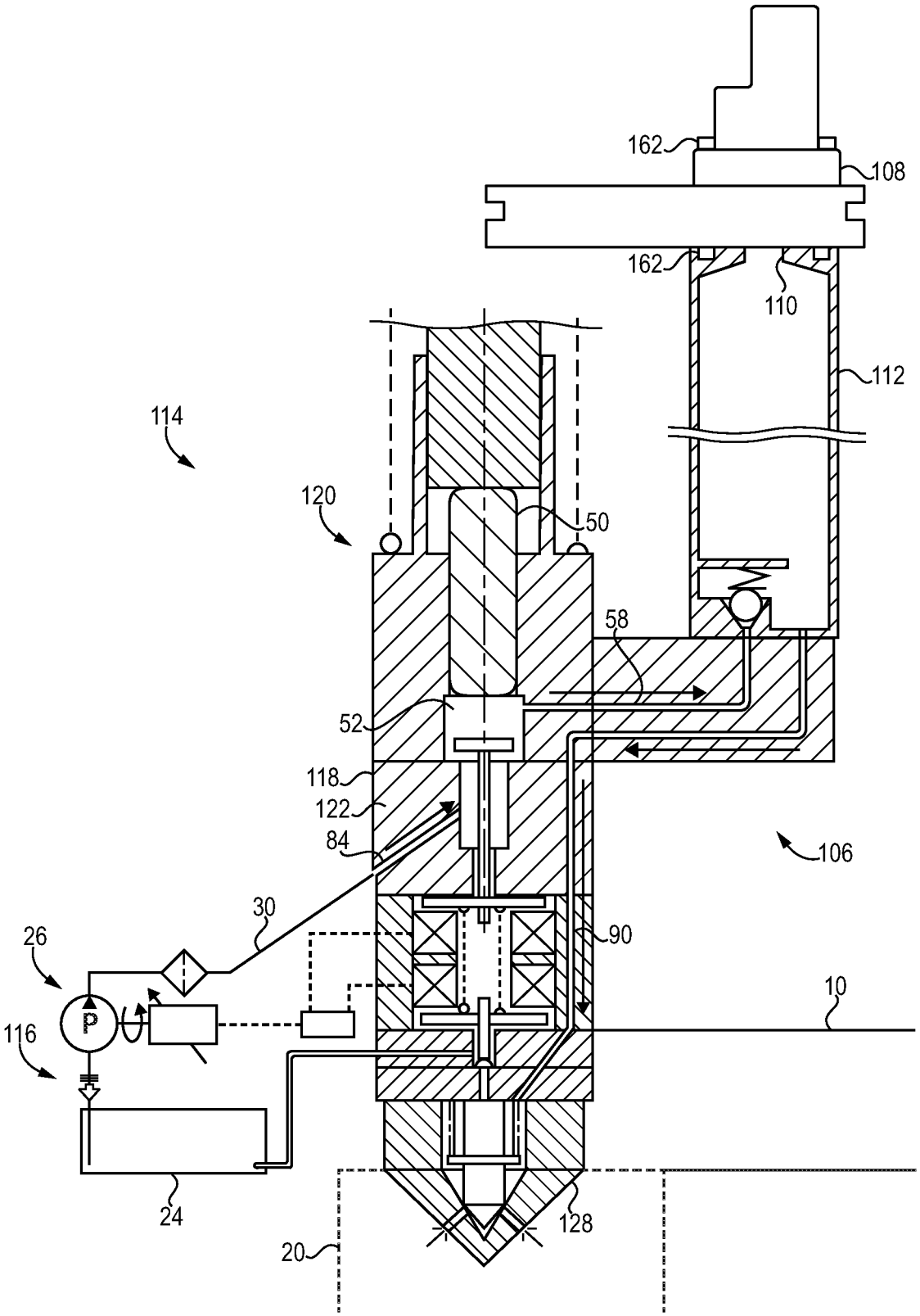
FIG. 7 is a schematic and diagrammatic illustration of an exemplary disclosed pressurized fuel system.
Figure 12:
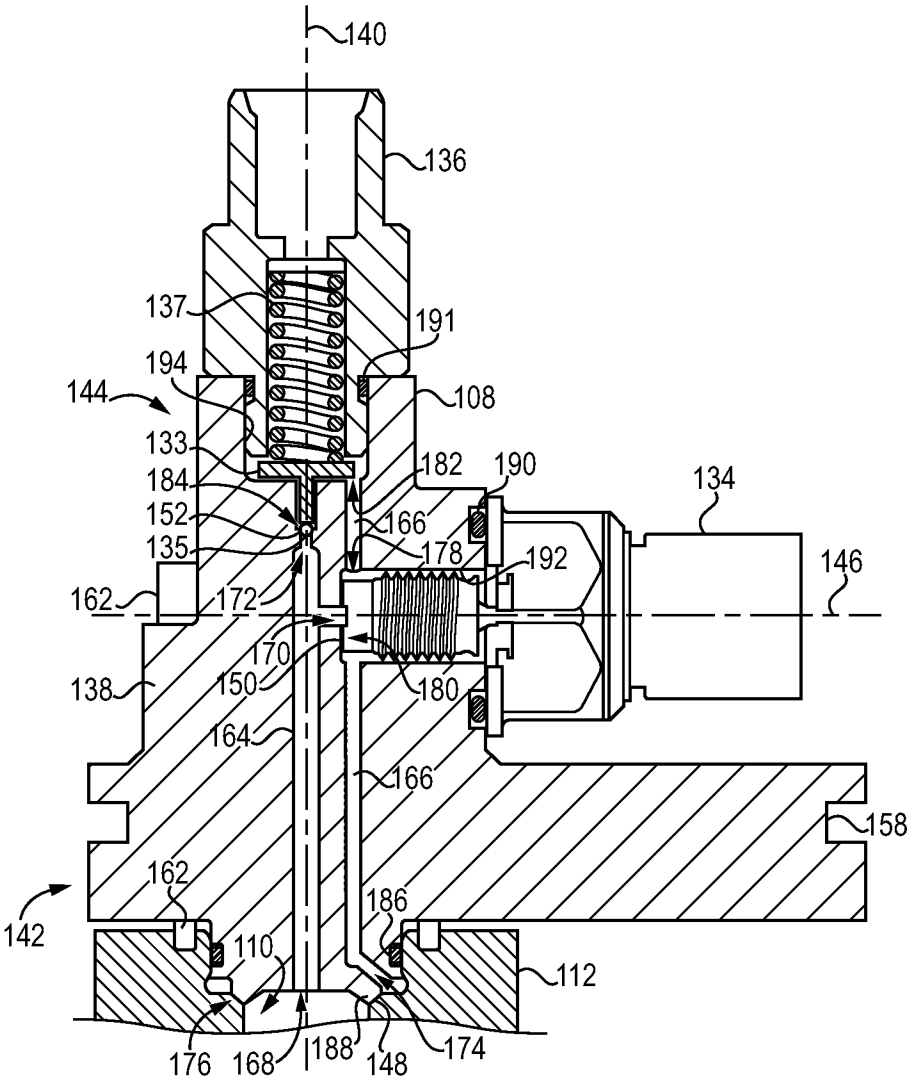
FIG. 12 is a sectioned diagrammatic view of a cap for a pressurized fuel system.

Referring now to FIG. 6, a fuel injector assembly ("assembly") 106 is shown in engine 10 according to another embodiment. It should be noted that like reference numerals will be used to describe like features across different embodiments without further explanation, it being understood such features may be identical in construction and function to their counterparts discussed above. Where different reference numerals are used for identical or similar features across different embodiments, the corresponding element names and numbers will be provided for reference. It should nevertheless be appreciated that no limitation is intended by way of the use of any particular reference numeral. Material differences between embodiments will be discussed herein. Absent such discussion, different embodiments should generally be understood to be alike in structure and function. Assembly 106 may be similar to fuel injector 28 in certain respects. For example, each assembly 106 includes a fuel injector 118, and a pressure vessel 112 attached thereto that may be similar to accumulator portion 48*d*. Fuel injector 118 may have a nozzle 128 that is similar to nozzle portion 48*b*, and a cam-actuated pump assembly ("pump assembly") 120 similar to pumping portion 48*a*. Pressure vessel 112 of the present embodiment includes a high-pressure accumulator (hereinafter "accumulator 112") having an elongate shape with a longitudinally extending cavity, which may be similar to pressure chamber 94, formed therein. In the illustrated embodiment, accumulator 112 is directly attached to the associated fuel injector 118, extending generally in longitudinal and parallel alignment with fuel injector 118. Accumulator 112 can further be seen to extend vertically upward from fuel injector 118 between the associated cylinder head 18 (not labeled in FIG. 6) and a valve cover 156. Assembly 106 differs from fuel injector 28 in that, among other things, assembly 106 includes a cap 108 attached to accumulator 112 for closing and/or sealing an opening 110 (as seen in FIGS. 7 and 12, discussed hereinafter) formed in accumulator 112. In other embodiments, cap 108 may be attached to assembly 106 at a different location, or cap 108 may be attached to a different pressure vessel than an accumulator dedicated to and directly attached to a fuel injector.

Referring now also to FIG. 7, a sectioned diagrammatic and schematic view of assembly 106 in a pressurized fuel injection system ("fuel system") 114 is shown. Fuel system 114 includes one or more assemblies 106, each being associated with one of the plurality of cylinders 14. Fuel system 114 may be similar to fuel system 22 in many respects. For example, like fuel injectors 28 in fuel system 22, each assembly 106 in fuel system 114 may be fluidly coupled with a low-pressure fuel conduit 116 having components such as tank 24, fuel pumping arrangement 26, and supply passages 30. Pump assembly 120 may be fluidly coupled with accumulator 112 and may pressurize and/or move fuel through fuel system 114 by way of reciprocation of plunger 50 within bore 52. Injector body 48 of fuel injector 118 may include inlet passage 84, discharge passage 58, and accumulator passage 90, each at least partially formed therein. Inlet passage 84 may fluidly couple fuel injector 118 with low-pressure fuel conduit 116 to facilitate drawing of low-pressure fuel into fuel injector 118 from low-pressure fuel conduit 116. Each fuel injector 118 may further include one or more electrically-actuated control valves (not numbered), which may be similar or identical to spill valve 70 and/or control valve 74, to control a flow of fuel through fuel system 114. Discharge passage 58 may be structured to convey pressurized fuel from pump assembly 120 to the attached accumulator 112, and accumulator passage 90 may fluidly couple accumulator 112 with nozzle 128 for conveying high-pressure fuel to nozzle 128 for injection into an associated combustion chamber 20.

Figure 8:
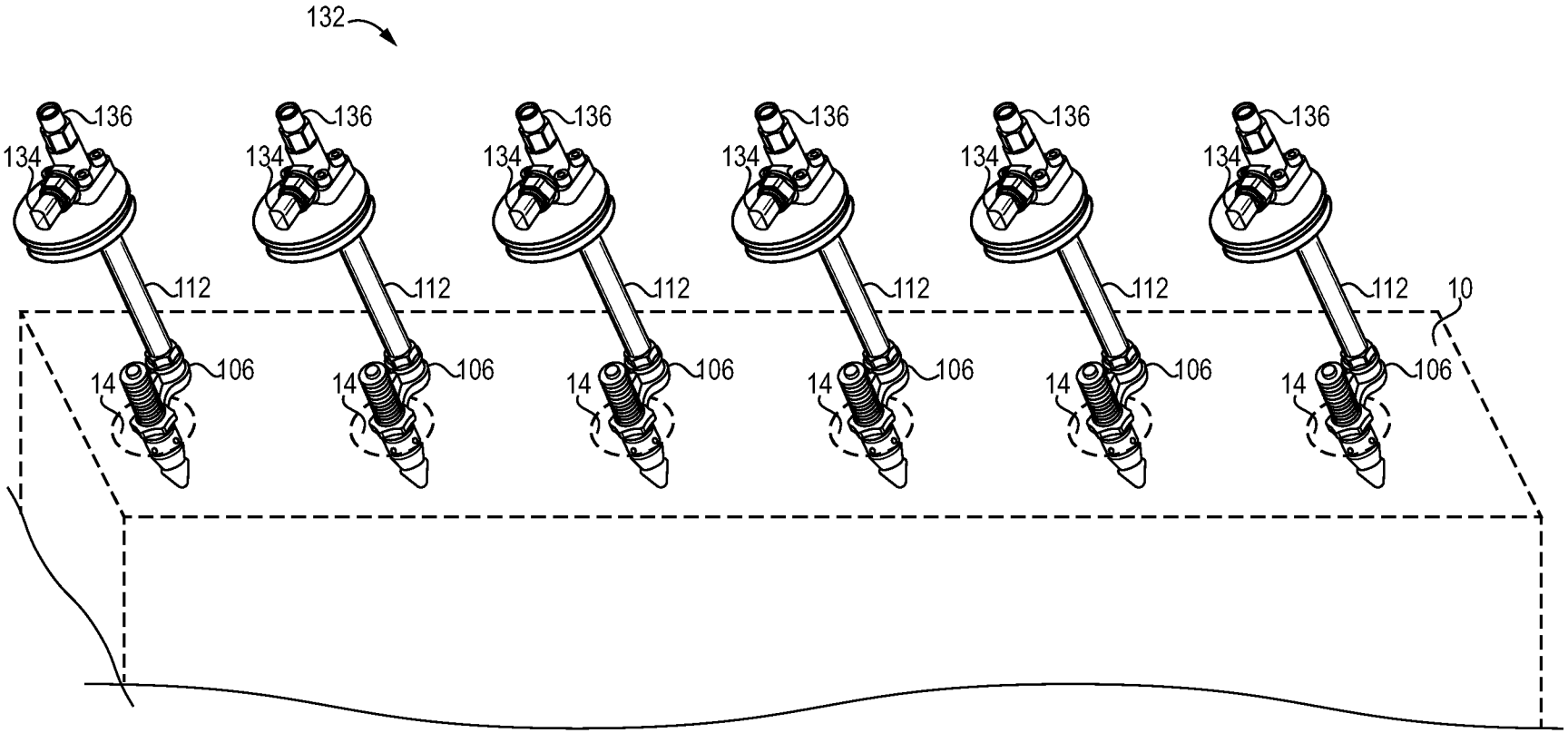
FIG. 8 is a perspective illustration of exemplary disclosed portions of the fuel system of FIGS. 6 and 7.
Figure 9:
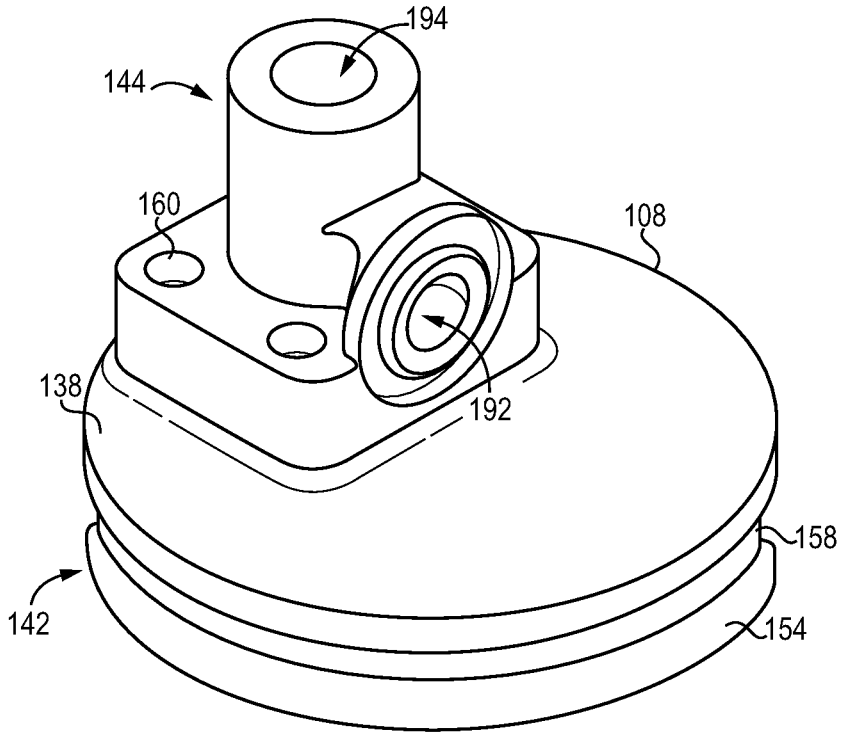
FIG. 9 is a diagrammatic view of a cap for a pressurized fuel system.
Figure 10:
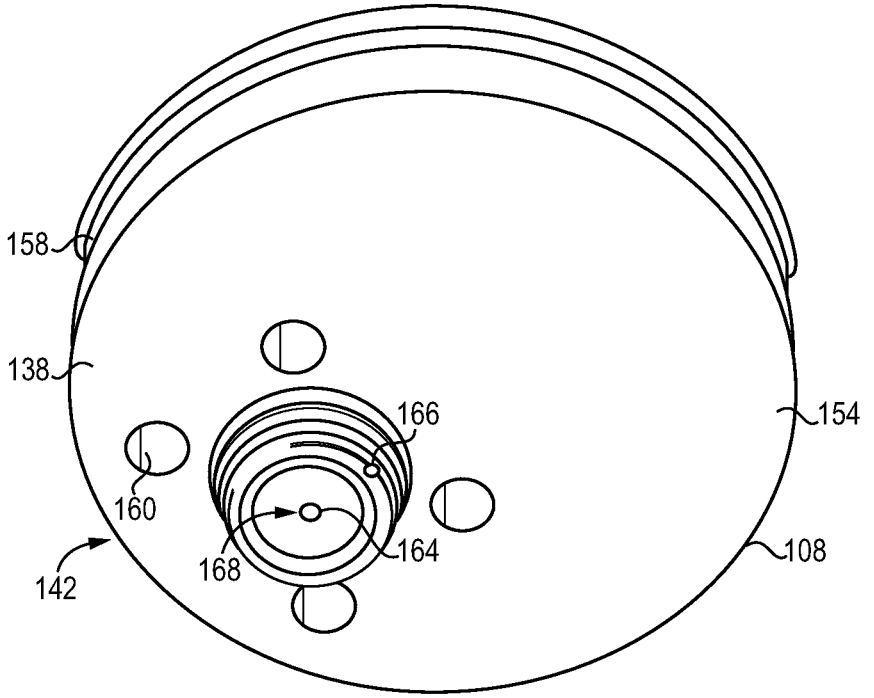
FIG. 10 is a diagrammatic view of a cap for a pressurized fuel system.

Referring now also to FIG. 8, fuel system 114 is shown in an exemplary fuel injector assembly arrangement ("arrangement") 132 that may be used in some configurations of fuel system 114 of engine 10. Arrangement 132, unlike arrangements 100, 104, includes a single type of fuel injector assembly, assembly 106, with each assembly 106 extending partially into one of the plurality of cylinders 14. Alternative embodiments of fuel system 114 may have arrangements that include one or more assemblies 106 interspersed with different types of fuel injectors or may otherwise include more than one type of fuel injector, such as fuel injectors 28, 102, or have fuel injectors that are not direct injected, but instead port injected or having another arrangement. It will be appreciated that some embodiments of fuel system 22 may also have fuel injector and/or fuel injector assembly arrangements that include one or more assemblies 106. Other embodiments of fuel systems 22, 114 may include different numbers and/or arrangements of fuel injectors and/or fuel injector assemblies still. As can be seen in FIG. 8, exemplary fuel system 114 does not include a common rail or any other type of shared pressure vessel, and the plurality of fuel injector assemblies 106 each include a stand-alone fuel injector assembly in which the corresponding high-pressure accumulator 112 is fluidly isolated from each of the high-pressure accumulators 112 of the other ones of the plurality of fuel injector assemblies 106. As discussed further herein, one or more assemblies 106 may include cap 108 to close opening 110, which may allow for a stand-alone pressurized fuel system in each assembly 106 capable of pressurizing low-pressure fuel and storing that pressurized fuel. In alternative embodiments, fuel system 114 may include a common rail, with one or more fuel injectors and/or fuel injector assemblies coupled to the common rail. It will thus be appreciated that systems could be designed in the present context having, for instance, two fuel injector assemblies with a common rail or other shared pressure vessel and ten stand-alone fuel injector assemblies, seven shared and five stand-alone, only one stand-alone, or a great many different combinations depending upon engine type, application, and cylinder number.

Figure 11:
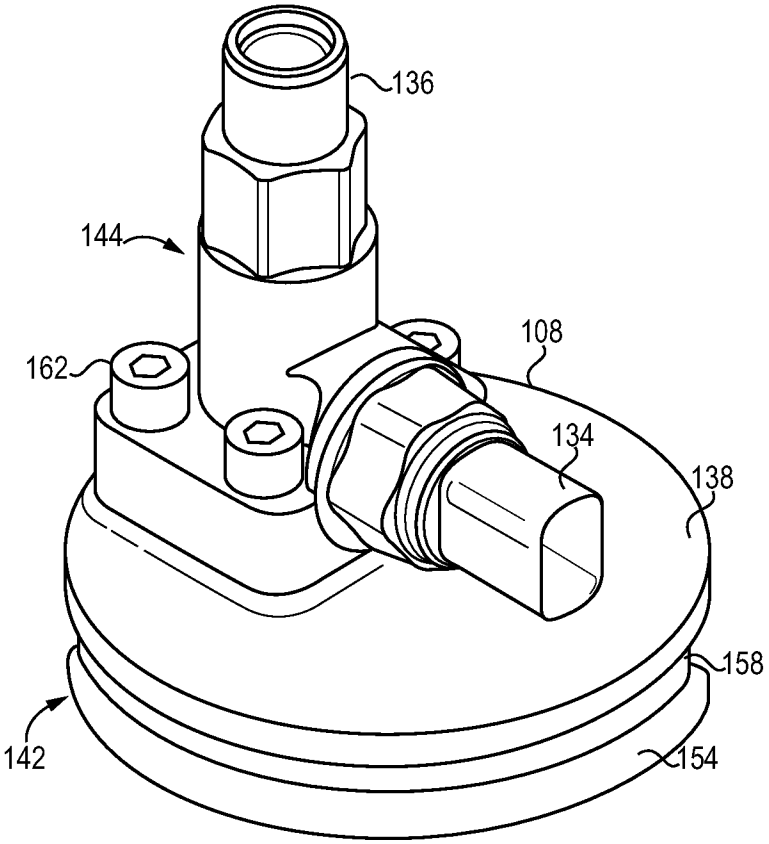
FIG. 11 is a diagrammatic view of a cap for a pressurized fuel system.

Referring now also to FIGS. 9 through 12, various views of an exemplary embodiment of cap 108 are shown. Cap 108 includes a cap body 138 defining a longitudinal axis 140 extending between a proximal cap body end 142 and a distal cap body end 144. Cap body 138 also defines a transverse axis 146 oriented perpendicular to longitudinal axis 140. In other embodiments, transverse axis 146 may cross longitudinal axis 140 at a different angle or might not cross longitudinal axis 140 at all. Assembly 106 may include one or more pressure control components (discussed hereinafter) for monitoring and/or adjusting fuel pressure in fuel system 114. As seen in FIGS. 6-8 and 11-12, cap 108 may be structured to at least partially receive the one or more pressure control components. One or more pressure control component bores (discussed hereinafter) sized and shaped to receive a pressure control component may be formed in cap body 138 to at least partially receive the one or more pressure control components. The exemplary disclosed assembly 106 includes a first pressure control component 134 and a second pressure control component 136, wherein first pressure control component 134 includes a pressure sensor (hereinafter "pressure sensor 134") structured to measure, monitor, or otherwise detect or observe a fluid pressure magnitude or other fluid pressure property in accumulator 112, and second pressure control component 136 includes a hydraulically-actuated pressure relief valve (PRV) (hereinafter "PRV 136"). PRV 136 may be structured to relieve pressure in accumulator 112 in excess of a predetermined threshold value. As seen in FIG. 12, PRV 136 might include components such as a pin 133 and a ball 135 structured to release fluid pressure when pressure in accumulator 112 meets or exceeds the threshold value, and may include a spring 137 that biases PRV 136 to a closed position when pressure in accumulator 112 is below the threshold value. In other embodiments, cap 108 may be structured to receive only one pressure control component, or may be structured to receive three or more pressure control components, with a corresponding number of pressure control component bores formed in cap body 138. Cap 108 of the present embodiment has a first pressure control component bore 192 and a second pressure control component bore 194, each being structured to receive a pressure control component. As can be seen in FIGS. 11 and 12, pressure sensor 134 is positioned at least partially within a first pressure control component bore 192 (hereinafter "pressure sensor bore 192"), and PRV 136 is positioned at least partially within a second pressure control component bore 194 (hereinafter "PRY bore 194"). In some embodiments, the position of PRV 136 and pressure sensor 134, and therefore bores 192, 194, may be reversed. Bores 192, 194 may be formed in cap body 138 around axes 146, 140, respectively. In other embodiments, the pressure control components may be positioned in cap 108 in a different configuration. For example, two pressure control components might be attached to a side of cap 108 at 45 degree angles to longitudinal axis 140, or may both extend laterally out from the side such that both are parallel with transverse axis 146.

Cap body 138 may further include a valve cover seal portion 154 at proximal cap body end 142 structured to seal an opening (not numbered) in valve cover 156 of engine 10. Valve cover seal portion 154 may further include an annular groove 158 that extends around a perimeter of cap 108, and may have a sealing element 159 disposed therein for forming a seal with valve cover 156. Sealing element 159 may be, for example, an O-ring formed of rubber or other suitable material. One or more fastener bores 160 may extend through cap body 138 at proximal cap body end 142, each being structured to receive a fastener 162 for attaching and clamping cap 108 to accumulator 112. In some embodiments, different strategies may be used to attach cap 108 to accumulator 112. For example, cap 108 might have threads formed on a protrusion 188 that extends out of valve cover seal portion 154 to allow cap 108 to be screwed into accumulator 112, or cap 108 could be attached to accumulator 112 by crimping, welding, or still other suitable techniques.

As also seen in FIG. 12, cap body 138 has a high-pressure passage 164 and a low-pressure passage 166 formed therein. High-pressure passage 164 may be structured to fluidly couple accumulator 112 with one or more pressure control components positioned at least partially within or otherwise coupled with cap 108. High-pressure passage 164 may include a first high-pressure opening 168, a second high-pressure opening 170, and a third high-pressure opening 172 surrounded, respectively, by a first sealing surface 148 at proximal cap body end 142 that extends circumferentially around longitudinal axis 140, a second sealing surface 150 extending circumferentially around transverse axis 146, and a third sealing surface 152 also extending circumferentially around longitudinal axis 140. Further, protrusion 188 may extend circumferentially around longitudinal axis 140 at proximal cap body end 142, with first sealing surface 148 being located thereon. Accumulator 112 may be fluidly coupled with high-pressure passage 164 by way of first high-pressure opening 168, which may allow high-pressure fuel from accumulator 112 to pass into high-pressure passage 164. Second and third high-pressure openings 170, 172 may fluidly couple high-pressure passage 164 with pressure sensor 134 and PRV 136, respectively, thereby allowing fuel pressure to be monitored, measured, or otherwise detected, or to allow PRV 136 to relieve pressure in accumulator 112.

Low-pressure passage 166 may be structured to receive fuel leaked past one or more high-pressure seals. The exemplary cap 108 of FIG. 12 includes a first drain opening 174 outboard of first sealing surface 148 to receive fuel leaked past a first metal to metal fluid seal 176 formed between first sealing surface 148 and accumulator 112, a second drain opening 178 outboard of second sealing surface 150 to receive fuel leaked past a second metal to metal fluid seal 180 formed between second sealing surface 150 and pressure sensor 134, and a third drain opening 182 outboard of third sealing surface 152, which may form a third metal to metal fluid seal 184 with PRV 136. Some embodiments may include a different number of drain openings and/or may have a different configuration of the drain openings. For instance, one embodiment includes only a single pressure control component and may therefore have only two sealing surfaces, with drain openings positioned outboard of the two sealing surfaces.

Cap 108 may also be understood to include or be part of a double wall sealing system to prevent fuel from leaking out of assembly 106. Each sealing surface 148, 150, 152 may form an inner wall of the double wall sealing system. Cap 108 may include a first, a second, and a third annular sealing element 186, 190, 191, which might form an outer wall of the double wall sealing system. First annular sealing element 186 may extend circumferentially around cap body 138 at proximal cap body end 142, with first drain opening 174 being positioned between first sealing surface 148 and first annular sealing element 186. First annular sealing element 186 might be an O-ring riding in a groove on cap 108 and may be radially compressed between protrusion 188 and accumulator 112, though embodiments in which the first annular sealing element 186 is configured differently, for instance, being compressed axially, or positioned upon the accumulator, are also contemplated. Third annular sealing element 191 may also be radially compressed and may ride on PRV 136, while second annular sealing element 190 may be axially compressed between pressure sensor 134 and ride on cap 108. It will be appreciated that a variety of alternative embodiments in which each of annular sealing elements 186, 190, 191 may be compressed or positioned differently are also contemplated. Each of first drain opening 174, second drain opening 178, and third drain opening 182 may open to low-pressure passage 166 and be located fluidly between the inner wall and the outer wall of the double wall sealing system. One of the second or third drain openings 178, 182 may be within pressure sensor bore 192 or PRV bore 194 such that the bore is in fluid communication with low-pressure passage 166. Pressure sensor bore 192 or PRV bore 194 may further include threads formed therein, with the one of the second or the third drain opening 178, 182 being positioned between the threads and the corresponding second or third sealing surface 150, 152.

INDUSTRIAL APPLICABILITY

The fuel injectors and systems of the present disclosure have wide application in a variety of engine types including, for example, diesel engines and gasoline engines. The disclosed fuel injectors and systems may facilitate high performance of the associated engine in a simple, flexible, and low-cost configuration. Operation of systems 22, 114 will now be explained.

A controlled injection event may start by first receiving an indication of a desired start of injection (SOI) timing, a desired injection amount, a desired SOI pressure, and/or a desired end of injection (EOI) pressure. For example, engine 10 may request an SOI corresponding to a particular position of piston 16 within cylinder 14. Similarly, engine 10 may request a specific quantity of fuel, an SOI pressure, and/or an EOI pressure. These requested (e.g., desired) injection characteristics may be received by controller 32 (referring to FIG. 2) in preparation for the injection event.

After receiving the desired fuel injection characteristics, controller 32 may determine a start of current (SOC) for second electrical actuator 82 that will move control valve 74 to the open position and initiate injection at the desired SOI timing. As indicated above, movement of control valve 74 toward the energized flow-passing position may cause an imbalance of pressure that moves valve needle 64 toward the orifice-opening position, thereby initiating injection of fuel into combustion chamber 20. Controller 32 may determine the SOC by offsetting the desired SOI by system delays associated with control valve 74 and valve needle 64.

Controller 32 may determine an EOI timing that corresponds with injection of the desired quantity of fuel. Using known kinematics of nozzle and valve portions 48*c* and 48*d* and based on known or assumed fuel pressures inside accumulator portion 48*d*, accumulator 112, and/or common rail 96, controller 32 may calculate a delay after SOI required for the desired amount of fuel to pass through orifices 62. Controller 32 may then calculate an end of current (EOC) that accounts for delays associated with control valve 74 such that by the end of the injection at the determined EOI timing, the proper amount of fuel has been injected into combustion chamber 20.

Controller 32 may end injection by terminating the current supplied to second electrical actuator 82 at the calculated EOC timing such that control valve 74 moves to the closed position in time for the pressures acting on valve needle 64 to balance and allow movement thereof back to block orifices 62 at the EOI timing.

Because the fuel injected through orifices 62 may be linked primarily to a pressure of fuel within pressure chamber 94 of accumulator portion 48*d* or accumulator 112 (i.e., and not necessarily linked to pumping operations of plunger 50), fuel injecting by injectors 28 may be performed somewhat independent of fuel pumping. For example, controller 32 may determine a SOC for first electrical actuator 80 associated with spill valve 70 that results in a desired pressure inside of pressure chamber 94 of accumulator portion 48*d*, accumulator 112, and/or inside of common rail 96, regardless of when fuel is being injected. As indicated above, the amount of displacement of plunger 50 into bore 52 after spill valve 70 has been moved to the flow-blocking position may correspond to an amount of fuel displaced into pressure chamber 94 or accumulator 112 and a resulting pressure. Controller 32 may be programmed with geometric relationships between an angular position of cam arrangement 40, a stroke length and area of plunger 52, and/or a displacement position of plunger 50 within bore 52. From these geometric relationships and the desired displacement amount and/or resulting pressure, controller 32 may calculate a SOC for first electrical actuator 80 (e.g., in terms of crank angle, cam angle, and/or displacement position of plunger 50). When plunger 50 moves through the subsequent displacement, a desired amount of fuel may be pushed from bore 52 to raise a pressure inside of chamber ca or accumulator 112 to a desired level. Controller 32 may be further configured to account for delays associated with spill valve 70 when determining SOC of first electrical actuator 80.

The disclosed arrangement may be simple and inexpensive. In particular, fuel injectors 102 may have fewer control requirements and cost less than fuel injectors 28 because they do not have pumping capabilities. Accordingly, because arrangements 100 and 104 may allow use of only a limited number of fuel injectors 28 (i.e., and a greater number of fuel injectors 102), the corresponding arrangements may be simpler and less expensive than if arrangements 100 and 104 utilized only fuel injectors 28.

In addition, because the pumping action of fuel injectors 28 and assemblies 106 may be at least somewhat independent of the injecting action, the pumping action may occur over a greater period of time during each combustion cycle. That is, the pumping action may not be limited to only a period during which fuel is injected. As discussed hereinafter assemblies 106 may act independently of any shared pressure vessel to pressurize and inject fuel. Each injection of fuel by assembly 106 to combustion chamber 20 may cause fluid pressure in accumulator 112 to drop. Further, leakage of high-pressure fuel past fluid seals 176, 180, 184, if any leakage occurs, may cause the fluid pressure level in accumulator 112 to drop over time if the pressure is not replenished. Pump assembly 120 may be configured to pressurize fuel during and between fuel injections in order to charge accumulator 112. Put differently, pump assembly 120 may be structured to deliver pressurized fuel to accumulator 112 at a rate that allows accumulator 112 to be refilled with pressurized fuel to a desired pressure between fuel injections. This separation of pumping from injection may also allow for the torque associated with the pumping action to be spread over a greater amount of time (and a greater amount of cam surface area), resulting in a lower peak torque and less wear. A lower peak torque passing through cam arrangement 40 during pumping may improve longevity of cam arrangement 40. In addition, the separation of pumping from injection may allow for as short of an injection duration as desired. Even further, injector 28 may be used alone and placed within each cylinder head 18 of engine 10, or used together in a connected arrangement with other injectors of the same or a different type. This may allow for flexibility in designing engine 10, as well as retrofitting of existing engines with complex supply and/or routing requirements.

Systems including assembly 106 may also have the capability for closed-loop control of fuel pressure in each assembly 106, allowing for independent diagnostics, trimming, or pressure control and evaluation for still other purposes. Referring now again to FIG. 8, it can be seen that each assembly 106 may be capable of pressurizing fuel and storing the pressurized fuel for later injection into combustion chamber 20, with pressure data collected from that assembly 106 rather than data collected from a common rail employed for control purposes. Assemblies 106 having attached pressure control components may provide for still other advantages. For example, a pressure sensor 134 positioned on assembly 106 and dedicated to monitoring, measuring, or otherwise detecting or observing fluid pressure only in the accumulator 112 attached thereto may allow for more targeted, responsive feedback control of fluid pressure in that assembly 106 than could be achieved in a common rail system. This stand-alone configuration may also allow each assembly 106 to be replaced and/or repaired independently of other fuel injectors or fuel injector assemblies in the fuel system. In this way, a fuel system utilizing one or more assemblies 106 may allow for faster and/or more cost-efficient servicing. It will also be appreciated that a stand-alone configuration may decrease the total volume of fuel with respect to fluid storage as connecting lines between injector assemblies are unnecessary, although the accumulator volume in a stand-alone configuration may be greater for each accumulator than a design where multiple accumulators are connected together.

Finally, positioning of pressure sensor 134 and/or PRV 136 on cap 108 may allow for each to share a common high-pressure passage 164 and/or low-pressure passage 166, either or both of which may be formed within cap body 138. As discussed above, low-pressure passage 166 may be structured to receive high-pressure fuel leaked past fluid seals 176, 180 into drain openings 174, 178, respectively. Further, third drain opening 182 is fluidly coupled with low-pressure passage 166. Fuel in low-pressure passage 166 may be drained from assembly 106 through PRV 136, which may be fluidly coupled with a drain line (not pictured) in fluid communication with tank 24. This unified configuration may allow for easier, more efficient installation and/or removal by service technicians and provides for a simpler design than what might be obtained without a shared drain outlet.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. It will be appreciated that certain features and/or properties of the present disclosure, such as relative dimensions or angles, may not be shown to scale. As noted above, the teachings set forth herein are applicable to a variety of different devices, assemblies, and systems having a variety of different structures than those specifically described herein. Other aspects, features and advantages will be apparent upon an examination of the attached drawings and appended claims. As used herein, the articles "a" and "an" are intended to include one or more items, and may be used interchangeably with "at least one." Where only one item is intended, the term "one" or similar language is used. Also, as used herein, the terms "has," "have," "having," or the like are intended to be open-ended terms.

What is claimed is:

1. A cap for closing an opening in a pressure vessel in a pressurized fuel injection system, the cap comprising:

a cap body defining a longitudinal axis extending between a proximal cap body end and a distal cap body end, and a transverse axis;

the cap body having a first sealing surface extending circumferentially around the longitudinal axis, a second sealing surface extending circumferentially around the transverse axis, and a third sealing surface;

the cap body further having formed therein a high-pressure passage including a first high-pressure opening, a second high-pressure opening, and a third high-pressure opening surrounded, respectively, by the first sealing surface, the second sealing surface, and the third sealing surface; and the cap body further having formed therein a low-pressure passage including a first drain opening outboard of the first sealing surface to receive fuel leaked past a first seal formed between the first sealing surface and the pressure vessel, a second drain opening outboard of the second sealing surface to receive fuel leaked past a second seal formed between the second sealing surface and a pressure control component, and a third drain opening outboard of the third sealing surface.

2. The cap of claim 1 wherein the cap body further includes a pressure control component bore formed therein, and one of the second drain opening or the third drain opening is within the pressure control component bore.

3. The cap of claim 2 further including threads formed within the pressure control component bore, and wherein the one of the second drain opening or the third drain opening is positioned between the threads and the corresponding second sealing surface or third sealing surface.

4. The cap of claim 1 further including a pressure control component positioned at least partially within the pressure control component bore, and wherein the pressure control component is a pressure relief valve or a pressure sensor.

5. The cap of claim 4 further including a second pressure control component, wherein the first pressure control component is a pressure sensor and the second pressure control component is a pressure relief valve, and wherein the second seal is formed between the second sealing surface and the pressure sensor, and a third seal is formed between the third sealing surface and the pressure relief valve.

6. The cap of claim 1 further comprising an annular sealing element extending circumferentially around the cap body at the proximal cap body end, and the first drain opening being positioned between the first sealing surface and the annular sealing element.

7. The cap of claim 6 further including a protrusion extending circumferentially around the longitudinal axis at the proximal cap body end, and the first sealing surface being located upon the protrusion.

8. The cap of claim 1 wherein the proximal cap body end includes a valve cover seal portion, and an annular groove extending around a perimeter of the valve cover seal portion.

9. The cap of claim 8 further including a fastener bore formed in the cap body and structured to receive a fastener for attaching the cap to the pressure vessel in the pressurized fuel injection system.

* * * * *